US008475124B2

(12) United States Patent
Dalsania et al.

(10) Patent No.: US 8,475,124 B2
(45) Date of Patent: Jul. 2, 2013

(54) EXHAUST HOOD FOR A TURBINE AND METHODS OF ASSEMBLING THE SAME

(75) Inventors: Prakash Dalsania, Bangalore (IN); Kamlesh Mundra, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 1283 days.

(21) Appl. No.: 11/939,137

(22) Filed: Nov. 13, 2007

(65) Prior Publication Data

US 2009/0123277 A1 May 14, 2009

(51) Int. Cl.
*F01D 9/04* (2006.01)

(52) U.S. Cl.
USPC ..... 415/207; 415/211.2

(58) Field of Classification Search
USPC ..... 415/211.2, 212.1, 207
See application file for complete search history.

(56) References Cited

U.S. PATENT DOCUMENTS

| | | | | |
|---|---|---|---|---|
| 3,120,374 | A * | 2/1964 | Herzog et al. | 415/211.2 |
| 3,859,786 | A | 1/1975 | Azelborn et al. | |
| 4,308,718 | A | 1/1982 | Mowill | |
| 4,391,564 | A * | 7/1983 | Garkusha et al. | 415/126 |
| 4,391,566 | A | 7/1983 | Takamura | |
| 4,392,615 | A | 7/1983 | Madden | |
| 4,459,802 | A | 7/1984 | Mowill | |
| 4,512,716 | A | 4/1985 | McHenry et al. | |
| 4,961,310 | A | 10/1990 | Moore et al. | |
| 5,209,634 | A * | 5/1993 | Owczarek | 415/150 |
| 5,257,906 | A * | 11/1993 | Gray et al. | 415/226 |
| 5,346,365 | A | 9/1994 | Matyscak | |
| 5,518,366 | A * | 5/1996 | Gray | 415/226 |
| 5,951,246 | A | 9/1999 | Uematsu et al. | |
| 6,634,176 | B2 | 10/2003 | Rouse et al. | |
| 6,792,758 | B2 | 9/2004 | Dowman | |
| 7,883,312 | B2 * | 2/2011 | Eguchi et al. | 415/119 |
| 2009/0257868 | A1 * | 10/2009 | Fonda-Bonardi | 415/211.2 |

FOREIGN PATENT DOCUMENTS

| | | |
|---|---|---|
| JP | 52153005 | 12/1977 |
| JP | 2007064190 | 3/2007 |
| RU | 2053373 C1 | 1/1996 |
| WO | 9855739 | 12/1998 |

OTHER PUBLICATIONS

English translation of RU Office Action dated Dec. 4, 2012 from corresponding RU Application No. 2008144697/06(058314).
English translation of JP Office Action dated Feb. 12, 2013 from corresponding JP Application 2008-288364.

* cited by examiner

*Primary Examiner* — Edward Look
*Assistant Examiner* — Aaron R Eastman
(74) *Attorney, Agent, or Firm* — Armstrong Teasdale LLP

(57) ABSTRACT

A method for assembling an exhaust hood for a turbine is provided. The method includes providing a bearing cone that substantially circumscribes a rotor of the turbine; and positioning a guide radially outward from the bearing cone. The guide and the bearing cone are configured to channel fluid from the turbine. The method also includes extending a guide cap from the guide. The guide cap is oriented to facilitate preventing the generation of fluid vortexes within the exhaust hood.

20 Claims, 5 Drawing Sheets

EXHAUST HOOD FOR A TURBINE AND METHODS OF ASSEMBLING THE SAME

BACKGROUND OF THE INVENTION

This invention relates generally to turbines, and more specifically, to exhaust hoods used with turbines.

Known steam turbine low pressure sections include an exhaust hood/diffuser that is coupled downstream from a last stage of the turbine. The exhaust hood enables static pressure of the steam to be recovered and guides the steam from the last stage to a condenser. Specifically, steam from the last stage is channeled to the condenser through the exhaust hood. Often steam discharged from the last stage has a high swirl and high flow gradient in radial direction. Moreover, a portion of the steam flows directly to the condenser through a lower half of the exhaust hood and the remaining steam travels through an upper half of the exhaust hood.

Typically, steam flowing through the upper half of the exhaust hood is turned 180° from a vertically upward flow direction to a downward flow direction and into the condenser. The change in the flow direction of the steam may generate a strong vortex behind a steam guide in the upper half of the hood. The vortex minimizes an effective flow area between the steam guide and an outer wall of the hood. Accordingly, flow losses in the steam path are increased, such that flow diffusion in the upper half of the exhaust hood is decreased. As such, known steam turbine hoods may decrease the performance of the turbine.

BRIEF DESCRIPTION OF THE INVENTION

In one aspect, a method for assembling an exhaust hood for a turbine is provided. The method includes providing a bearing cone that substantially circumscribes a rotor of the turbine; and positioning a guide radially outward from the bearing cone. The guide and the bearing cone are configured to channel fluid from the turbine. The method also includes extending a guide cap from the guide. The guide cap is oriented to facilitate preventing the generation of fluid vortexes within the exhaust hood.

In another aspect, an exhaust hood for a turbine is provided. The exhaust hood includes a bearing cone substantially circumscribing a rotor of the turbine, and a guide positioned radially outward from the bearing cone. The guide and the bearing cone are configured to channel fluid from the turbine. The exhaust hood also includes a guide cap that extends from the guide. The guide cap is oriented to facilitate preventing the generation of fluid vortexes within the exhaust hood.

In yet another aspect, a steam turbine is provided. The turbine includes a rotor having a plurality of stages. The turbine also includes an exhaust hood that is configured to channel steam from a last stage of the plurality of stages. The exhaust hood includes a bearing cone substantially circumscribing the rotor; and a guide positioned radially outward from the bearing cone. A guide cap extends from the guide. The guide cap is oriented to facilitate preventing the generation of fluid vortexes within the exhaust hood.

DETAILED DESCRIPTION OF THE INVENTION

The present invention provides an exhaust hood for a steam turbine. The exhaust hood is configured to channel steam from the turbine to a condenser. In the exemplary embodiment, the exhaust hood includes a guide cap that extends from a guide within the exhaust hood. The guide cap facilitates preventing the generation of steam vortexes within the exhaust hood, and also facilitates maximizing an effective steam flow area between the guide and an outer wall of the exhaust hood. In one embodiment, the guide cap extends from a rear surface of the guide to facilitate reducing an amount of steam flow along the rear surface.

It should be noted that although the present invention is described with respect to exhaust hoods that may be used with a steam turbine, one of ordinary skill in the art should understand that the present invention is not limited to being used only with steam turbines. Rather, the present invention may be used in any system that channels fluid. Further, for simplicity, the present invention is described herein only with respect to exhaust hoods. However, as would be appreciated by one of ordinary skill in the art, the present invention is not limited for use with exhaust hoods; but rather, the present invention may also be used with any apparatus that channels fluid.

Figure 1:
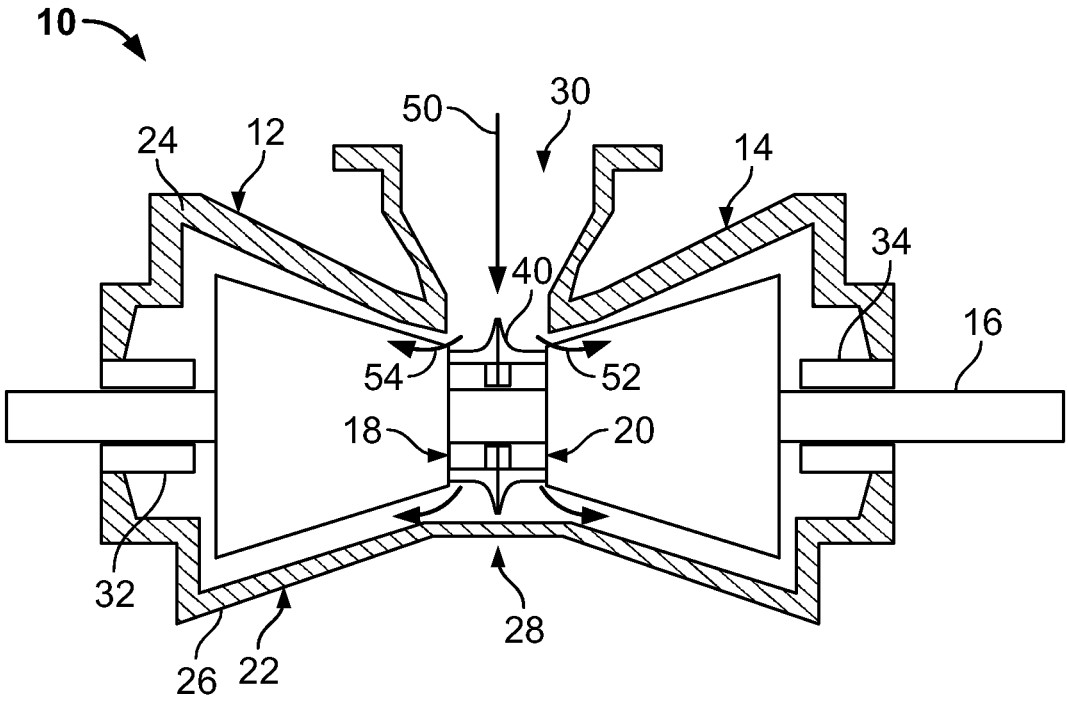
FIG. 1 is a schematic view of an exemplary opposed-flow steam turbine.

FIG. 1 is a schematic illustration of an exemplary opposed-flow steam turbine 10. Turbine 10 includes first and second low pressure (LP) sections 12 and 14. As is known in the art, each turbine section 12 and 14 includes a plurality of stages of diaphragms (not shown in FIG. 1). A rotor shaft 16 extends through sections 12 and 14. Each LP section 12 and 14 includes a nozzle 18 and 20. A single outer shell or casing 22 is divided along a horizontal plane and axially into upper and lower half sections 24 and 26, respectively, and spans both LP sections 12 and 14. A central section 28 of shell 22 includes a low pressure steam inlet 30. Within outer shell or casing 22, LP sections 12 and 14 are arranged in a single bearing span supported by journal bearings 32 and 34. A flow splitter 40 extends between first and second turbine sections 12 and 14.

It should be noted that although FIG. 1 illustrates an opposed-flow, low pressure turbine, as will be appreciated by one of ordinary skill in the art, the present invention is not limited to being used only with low pressure turbines and can be used with any opposed-flow turbine including, but not limited to intermediate pressure (IP) turbines and/or high pressure (HP) turbines. In addition, the present invention is not limited to only being used with opposed-flow turbines, but rather may also be used with single flow steam turbines as well, for example.

During operation, low pressure steam inlet 30 receives low pressure/intermediate temperature steam 50 from a source, such as, but not limited to, an HP turbine or IP turbine through a cross-over pipe (not shown). Steam 50 is channeled through inlet 30 wherein flow splitter 40 splits the steam flow into two opposite flow paths 52 and 54. More specifically, in the exemplary embodiment, the steam 50 is routed through LP sections 12 and 14 wherein work is extracted from the steam to rotate rotor shaft 16. The steam exits LP sections 12 and 14 and is routed to a condenser, for example.

Figure 2:
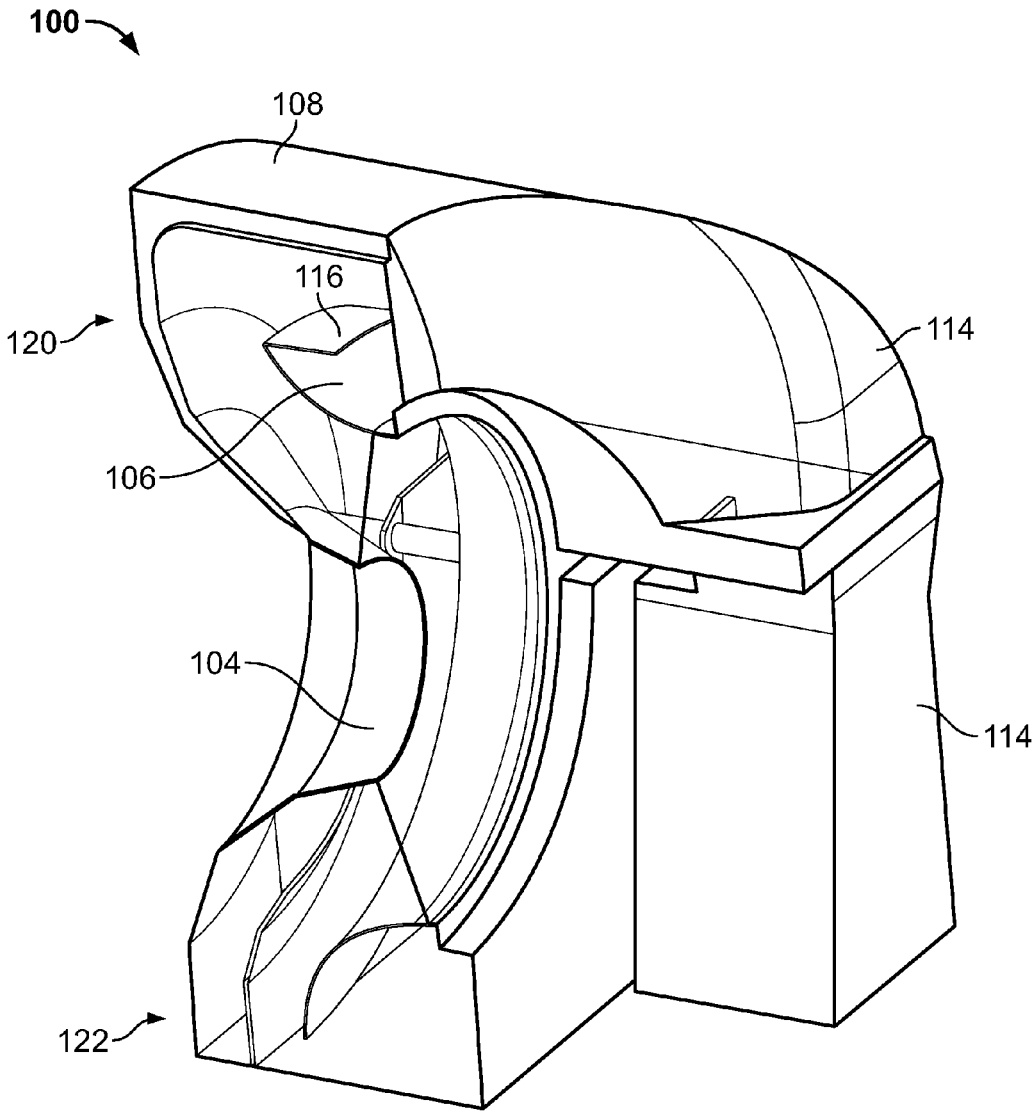
FIG. 2 is a cross-sectional perspective view of an exemplary exhaust hood that may be used with the low pressure turbine sections shown in FIG. 1.
Figure 3:
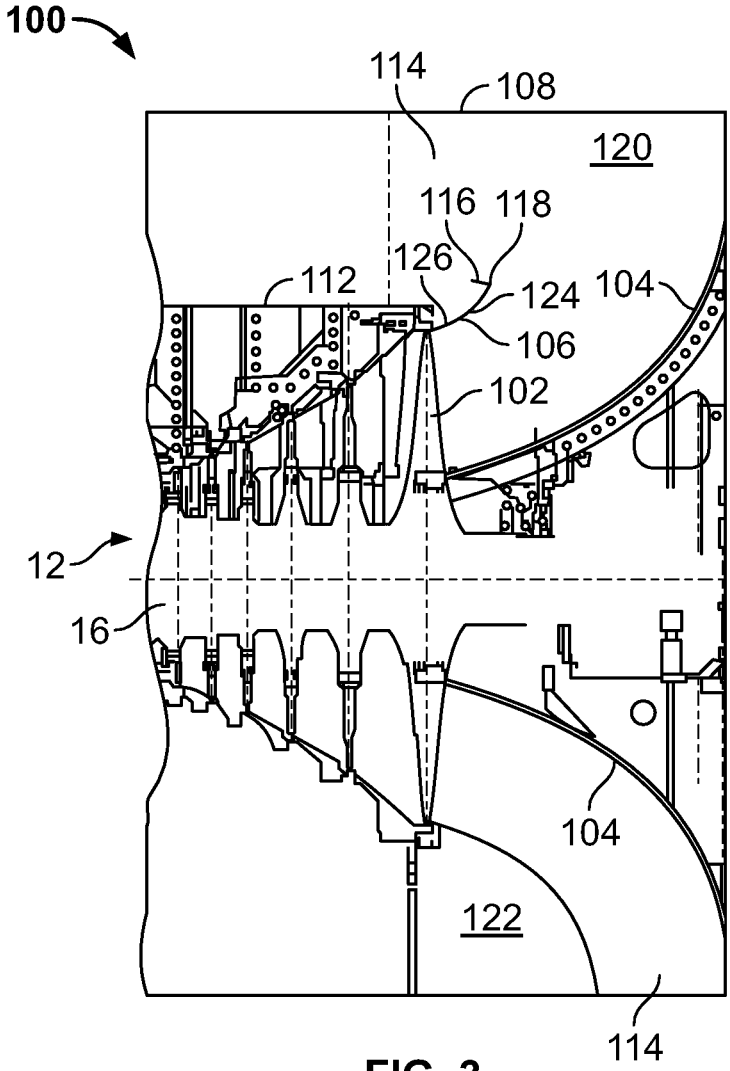
FIG. 3 is a schematic view of the exhaust hood shown in FIG. 2 coupled adjacent to the low pressure turbine section shown in FIG. 1.

FIG. 2 is a cross-sectional perspective view of an exemplary exhaust hood 100 that may be used with low pressure turbine section 12. Although FIG. 2 illustrates the hood 100 being used with low pressure turbine section 12, as should be appreciated by one of ordinary skill in the art, exhaust hood 100 could also be used with low pressure turbine section 14. FIG. 3 is a schematic view of exhaust hood 100 coupled to a portion of low pressure turbine section 12. Specifically, exhaust hood 100 is coupled adjacent to a last stage 102 of low pressure turbine section 12.

In the exemplary embodiment, exhaust hood 100 includes a bearing cone 104, a guide 106, and an outer wall 108. Bearing cone 104 substantially circumscribes rotor shaft 16 of low pressure turbine section 12, and guide 106 is positioned radially outward from bearing cone 104. More specifically, guide 106 is coupled to a casing 112 of low pressure turbine section 12. In an alternative embodiment, guide 106 is coupled to any portion of low pressure turbine section 12. In yet another embodiment, guide 106 is coupled to a portion of hood 100. In the exemplary embodiment, guide 106 and bearing cone 104 channel steam from low pressure turbine section 12 through an exhaust duct 114 of exhaust hood 100 to a condenser (not shown) that is coupled in fluid communication with exhaust hood 100. Outer wall 108 encloses exhaust hood 100 and facilitates preventing steam from undesirably leaking from exhaust hood 100.

In the exemplary embodiment, a guide cap 116 extends from an edge 118 of guide 106. In an alternative embodiment, guide cap 116 extends from any portion of guide 106. In one embodiment, guide cap 116 extends partially along edge 118. More specifically, exhaust hood 100 includes an upper half 120 and a lower half 122 and, in one embodiment, guide cap 116 extends along an edge 118 of upper half 120. In an alternative embodiment, guide cap 116 extends along any portion of edge 118. For example, in one embodiment, guide cap 116 extends along an edge 118 of upper half 120 and approximately thirty degrees into lower half 122 on both sides of exhaust hood 100. In a further alternative embodiment, guide cap 116 extends entirely along edge 118. In the exemplary embodiment, guide cap 116 extends from edge 118 towards low pressure turbine section 12. Guide 106 includes a front surface 124 and an opposite rear surface 126 and, in the exemplary embodiment, guide cap 116 extends from rear surface 126 towards low pressure turbine section 12. Accordingly, in the exemplary embodiment, guide cap 116 is substantially arcuate. However, in an alternative embodiment, guide cap 116 can have any shape that enables exhaust hood 100 to function as described herein.

During operation, guide cap 116 facilitates breaking down vortex formations behind steam guide 106. Accordingly diffusion of a flow of steam between the exhaust hood guide 106 and outer wall 108 is improved. The improved diffusion thereby improves static pressure recovery within exhaust hood 100 and improves a uniform pressure gradient at a juncture of exhaust hood 100 and a last stage of the turbine.

Figure 4A:
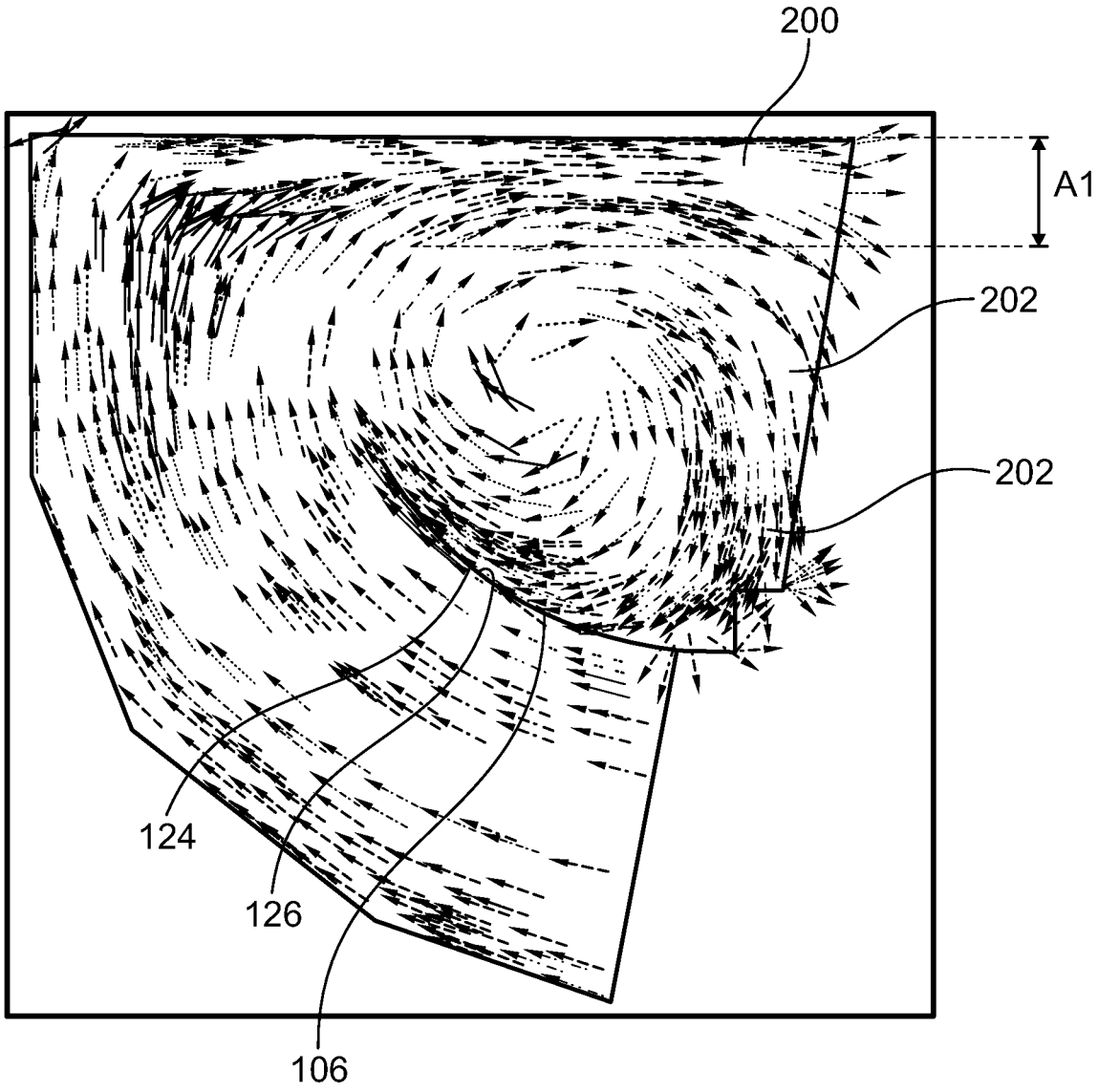
FIG. 4 is a schematic view of a flow of steam through an exhaust hood. Specifically, FIG. 4(*a*) is a schematic view of a flow of steam through an exhaust hood that does not include a guide cap, and FIG. 4(*b*) is a schematic view of a flow of steam through the exhaust hood shown in FIG. 2.
Figure 4B:
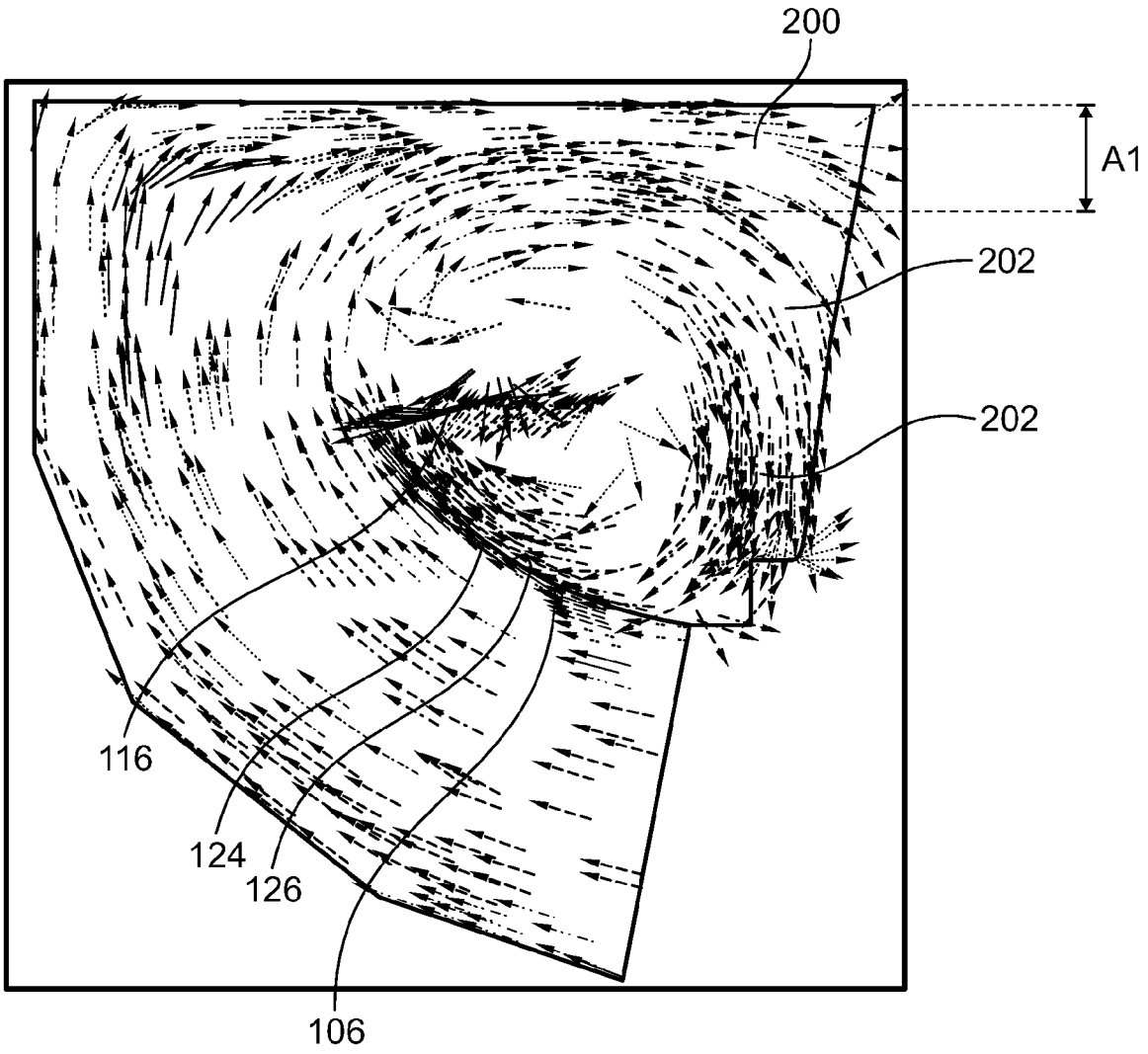

FIG. 4 is a schematic view of a flow of steam 200 through an exhaust hood. Specifically, FIG. 4(*a*) is a schematic view of the flow of steam 200 through an exhaust hood that does not include guide cap 116 (shown in FIG. 2). FIG. 4(*b*) is a schematic view of the flow of steam 200 through exhaust hood 100 including guide cap 116. As is illustrated in FIG. 4(*b*), guide cap 116 facilitates restricting an ancillary flow of steam 202 behind guide 106 and facilitates preventing the ancillary flow of steam 202 from mixing with the flow of steam 200. Preventing the mixture of steam flows 200 and 202 facilitates increasing an effective flow area $A_1$ defined between guide 106 and outer wall 108. As a result, improved diffusion of flow between guide 106 and outer wall 108 is facilitated, such that static pressure recovery within exhaust hood 100 is improved. Moreover, improved diffusion flow in upper half 120 of exhaust hood 100 facilitates the generation of a more uniform pressure gradient at a juncture of exhaust hood 100 and the last stage 102 of low pressure turbine section 12, thus, improving a performance of low pressure turbine section 12.

In one embodiment, the present invention facilitates improving static pressure recovery in exhaust hood 100 and, thereby, improves the heat rate or output of low pressure turbine 12. In the exemplary embodiment, assembling exhaust hood 100 with guide cap 116 is done with a relatively low increase in costs, as compared to the costs of assembling exhaust hood 100 without guide cap 116. However, the installation of guide cap 116 facilitates increasing turbine efficiency, while decreasing costs associated with operating and/or maintaining low pressure turbine section 12.

In one embodiment, a method for assembling an exhaust hood for a turbine is provided. The method includes providing a bearing cone that substantially circumscribes a rotor of the turbine; and positioning a guide radially outward from the bearing cone. The guide and the bearing cone are configured to channel fluid from the turbine. The method also includes extending a guide cap from the guide. The guide cap is oriented to facilitate preventing the generation of fluid vortexes within the exhaust hood. In the exemplary embodiment, the exhaust hood is configured to channel steam from the turbine to a condenser.

In the exemplary embodiment, the method includes extending an arcuate guide cap from the guide. In one embodiment, the guide cap extends along the guide within an upper half of the exhaust hood. In another embodiment, the guide cap extends from the guide towards the turbine.

Further, in the exemplary embodiment, the method includes orienting the guide cap to facilitate increasing an effective fluid flow area between the guide and an outer wall of the exhaust hood. In another embodiment, the method includes extending the guide cap from a rear surface of the guide to facilitate reducing an amount of fluid flow along the rear surface.

The above-described systems and methods facilitate improving the diffusion of a flow of steam between the exhaust hood guide and an outer wall of the exhaust hood. Accordingly, a static pressure recovery within the exhaust hood is improved and a uniform pressure gradient at a juncture of the exhaust hood and a last stage of the turbine is facilitated. As such, a performance of the turbine is increased, while costs associated with operating and/or maintaining the turbine are decreased.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Exemplary embodiments of systems and methods for assembling an exhaust hood are described above in detail. The systems and methods illustrated are not limited to the specific embodiments described herein, but rather, components of the system may be utilized independently and separately from other components described herein. Further, steps described in the method may be utilized independently and separately from other steps described herein.

While the invention has been described in terms of various specific embodiments, those skilled in the art will recognize that the invention can be practiced with modification within the spirit and scope of the claims.

What is claimed is:

1. A method for assembling an exhaust hood for use with a turbine including a plurality of stages, said method comprising:

providing a bearing cone that substantially circumscribes a rotor of the turbine;

positioning a guide radially outward from the bearing cone, wherein the guide and the bearing cone are configured to channel fluid from the turbine; and extending a guide cap radially outwardly from an edge of the guide, such that the intersection of the guide cap and the guide define an acute angle that forms an abrupt transition therebetween, wherein the guide cap is formed from a thin curved plate that is oriented to facilitate preventing fluid vortexes within the exhaust hood.

2. A method in accordance with claim 1 wherein extending a guide cap from the guide further comprises extending a guide cap that is substantially arcuate.

3. A method in accordance with claim 1 wherein the exhaust hood includes an upper half and a lower half, said extending a guide cap from the guide further comprises extending the guide cap along the guide within the upper half of the exhaust hood.

4. A method in accordance with claim 1 wherein extending a guide cap from the guide further comprises extending the guide cap from the guide towards the turbine.

5. A method in accordance with claim 1 wherein extending a guide cap from the guide further comprises orienting the guide cap to facilitate increasing an effective fluid flow area between the guide and an outer wall of the exhaust hood.

6. A method in accordance with claim 1 wherein positioning a guide further comprises positioning the guide to channel steam from the turbine to a condenser.

7. A method in accordance with claim 1 wherein the guide includes a front surface and a rear surface, said extending a guide cap from an edge of the guide further comprises extending the guide cap from the rear surface to facilitate reducing an amount of fluid flow along the rear surface.

8. An exhaust hood for use with a turbine including a plurality of stages, said exhaust hood comprising:

a bearing cone substantially circumscribing a rotor of the turbine;

a guide positioned radially outward from said bearing cone, said guide and said bearing cone are configured to channel fluid from the turbine; and a guide cap extending radially outwardly from an edge of said guide, wherein an intersection defined between said guide cap and said guide defines an acute angle that forms an abrupt transition therebetween, wherein said guide cap is formed from a thin curved plate that is oriented to facilitate preventing fluid vortexes within said exhaust hood.

9. An exhaust hood in accordance with claim 8 wherein said guide cap is substantially arcuate.

10. An exhaust hood in accordance with claim 8 wherein said exhaust hood comprises an upper half and a lower half, said guide cap extends along said guide within said upper half of said exhaust hood.

11. An exhaust hood in accordance with claim 8 wherein said guide cap extends from said guide towards the turbine.

12. An exhaust hood in accordance with claim 8 wherein said guide cap is configured to increase an effective fluid flow area between said guide and an outer wall of said exhaust hood.

13. An exhaust hood in accordance with claim 8 wherein said exhaust hood is configured to channel steam from the turbine to a condenser.

14. An exhaust hood in accordance with claim 8 wherein said guide comprises a front surface and a rear surface, said guide cap extending from said rear surface to facilitate reducing an amount of fluid flow along said rear surface.

15. A steam turbine comprising:

a rotor comprising a plurality of stages; and an exhaust hood configured to channel steam from a last stage of said plurality of stages, said exhaust hood comprising:

a bearing cone substantially circumscribing said rotor;

a guide positioned radially outward from said bearing cone; and a guide cap extending radially outwardly from an edge of said guide, wherein an intersection defined between said guide cap and said guide defines an acute angle that forms an abrupt transition therebetween, wherein said guide cap is formed from a thin curved plate that is oriented to facilitate preventing fluid vortexes within said exhaust hood.

16. A steam turbine in accordance with claim 15 wherein said guide cap is substantially arcuate.

17. A steam turbine in accordance with claim 15 wherein said exhaust hood comprises an upper half and a lower half, said guide cap extends along said guide within said upper half of said exhaust hood.

18. A steam turbine in accordance with claim 15 wherein said guide cap extends from said guide towards the turbine.

19. A steam turbine in accordance with claim 15 wherein said guide cap is configured to increase an effective fluid flow area between said guide and an outer wall of said exhaust hood.

20. A steam turbine in accordance with claim 15 wherein said guide comprises a front surface and a rear surface, said guide cap extending from said rear surface to facilitate reducing an amount of fluid flow along said rear surface.

* * * * *